US006597254B2

(12) United States Patent
Fujino et al.

(10) Patent No.: US 6,597,254 B2
(45) Date of Patent: Jul. 22, 2003

(54) NONRECIPROCAL CIRCUIT DEVICE

(75) Inventors: Masaru Fujino, Otsu (JP); Takashi Takagi, Omihachiman (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/119,696

(22) Filed: Apr. 11, 2002

(65) Prior Publication Data

US 2002/0180549 A1 Dec. 5, 2002

(30) Foreign Application Priority Data

Apr. 26, 2001 (JP) ..... 2001-129738
Mar. 26, 2002 (JP) ..... 2002-086452

(51) Int. Cl.[7] ..... H01P 1/32
(52) U.S. Cl. ..... 333/1.1; 333/24.2
(58) Field of Search ..... 333/1.1, 24.2

(56) References Cited

U.S. PATENT DOCUMENTS 6,222,425 B1 * 4/2001 Okada et al. ..... 333/1.1
6,359,526 B1 * 3/2002 Ohira et al. ..... 333/1.1
2002/0017964 A1 * 2/2002 Okada et al. ..... 333/1.1

FOREIGN PATENT DOCUMENTS

JP 5-80009 10/1993

* cited by examiner

*Primary Examiner*—Terry D. Cunningham
*Assistant Examiner*—Quan Tra
(74) *Attorney, Agent, or Firm*—Keating & Bennett, LLP

(57) ABSTRACT

A nonreciprocal circuit device includes a magnet and a center electrode. The center electrode includes a nonmagnetic substrate having a first surface having a groove, a magnetic body provided on a second surface of the nonmagnetic substrate, and a center electrode conductor, with a portion of the center electrode conductor being arranged in the groove. The magnet applies a direct-current magnetic field to the magnetic body and is disposed in proximity to the magnetic body.

18 Claims, 3 Drawing Sheets

NONRECIPROCAL CIRCUIT DEVICE

BACKGROUND OF THE INVENTION

1. Field of the Invention

The present invention relates to a nonreciprocal circuit device such as a circulator and an isolator for use in a microwave band.

2. Description of the Related Art

Generally, lumped element isolators used in portable communication apparatuses such as cellular phones allow signals to pass only in the transmission direction, and inhibit transmission in the opposite direction. The recent trend toward lighter and smaller portable communication apparatuses has increased the demand for lighter and smaller isolators.

In order to meet such demands, Japanese Unexamined Utility Model Application Publication No. 5-80009 discloses a nonreciprocal circuit device including wound-wire center electrodes formed by winding center electrode conductors around a magnetic body to reduce the size and weight of the device. The center electrodes of this nonreciprocal circuit device have greater effective lengths to improve the inductance of the center electrodes and to reduce the diameter of the magnetic body.

However, the center electrodes are formed by winding the center electrode conductors around the magnetic body with the nonmagnetic substrate that is left at the bottom of the magnetic body for reinforcement when the thickness of the magnetic body is thin. Since the portions of the wound center electrode conductors at the bottom of the magnetic body are separated from the corresponding portion of the magnetic body by the nonmagnetic substrate, the insertion loss of the resulting isolator is not sufficiently low as required for isolators.

SUMMARY OF THE INVENTION

To overcome the above-described problems, preferred embodiments of the present invention provide a nonreciprocal circuit device including a magnetic body provided with a nonmagnetic substrate, that achieves miniaturization, weight reduction, and low insertion loss.

A preferred embodiment of the present invention provides a nonreciprocal circuit device including a center electrode including a nonmagnetic substrate including a first surface having a groove, a magnetic body provided on a second surface of the nonmagnetic substrate, and a center electrode conductor, a portion of the center electrode conductor being arranged in the groove, and a magnet for applying a direct-current magnetic field to the magnetic body, the magnet being disposed in proximity to the magnetic body.

Since the nonmagnetic substrate is provided with the groove and has a reduced thickness at the groove, the distance between the center electrode conductor and the magnetic body is greatly reduced as compared with the case where no groove is provided. Thus, the insertion loss greatly decreased. Moreover, since the depth of the groove in the nonmagnetic substrate can be controlled, the insertion loss is easily controlled. Furthermore, since a portion of the center electrode conductor is provided in the groove, displacement of the center electrode is effectively prevented.

Preferably, the magnetic body includes a side of the groove, and the nonmagnetic substrate includes a base of the groove.

The depth of the groove is arranged to reach an interface between the nonmagnetic substrate and the magnetic body. Also, the magnetic body defines a base of the groove. Moreover, sides of the nonmagnetic substrate define sides of the groove.

According to this preferred embodiment of the present invention, the nonmagnetic substrate is not provided between the center electrode conductor and the magnetic body, and the thickness of the magnetic body is sufficiently maintained. Therefore, the insertion loss of structure described above is greatly reduced.

Preferably, the center electrode conductor includes a wire having an insulating coat, and the center electrode conductor is either wound around the nonmagnetic substrate and the magnetic body or only wound around the magnetic body.

When the center electrode conductor is wound around the nonmagnetic substrate and the magnetic body, the windings of the conductor are not in direct contact with one another at the intersections of the windings since the conductor is provided with an insulating coat.

The magnetic body preferably includes a magnetic garnet single crystal so as to further reduce the insertion loss.

The magnetic body is preferably grown by liquid phase epitaxy. In this manner, the magnetic body has the same crystal structure as that of the substrate and has high crystallinity. Thus, a high-quality nonreciprocal circuit device having a low insertion loss is manufactured using this magnetic body.

The nonmagnetic substrate preferably includes a garnet single crystal. When both the nonmagnetic substrate and the magnetic body have the same garnet single crystal structure, a nonreciprocal circuit device having stable characteristics and low insertion loss is manufactured therefrom.

Further elements, characteristics, features and advantages of the present invention will become apparent from the following description of the preferred embodiments with reference to the attached drawings.

DETAILED DESCRIPTION OF PREFERRED EMBODIMENTS

Figure 1:
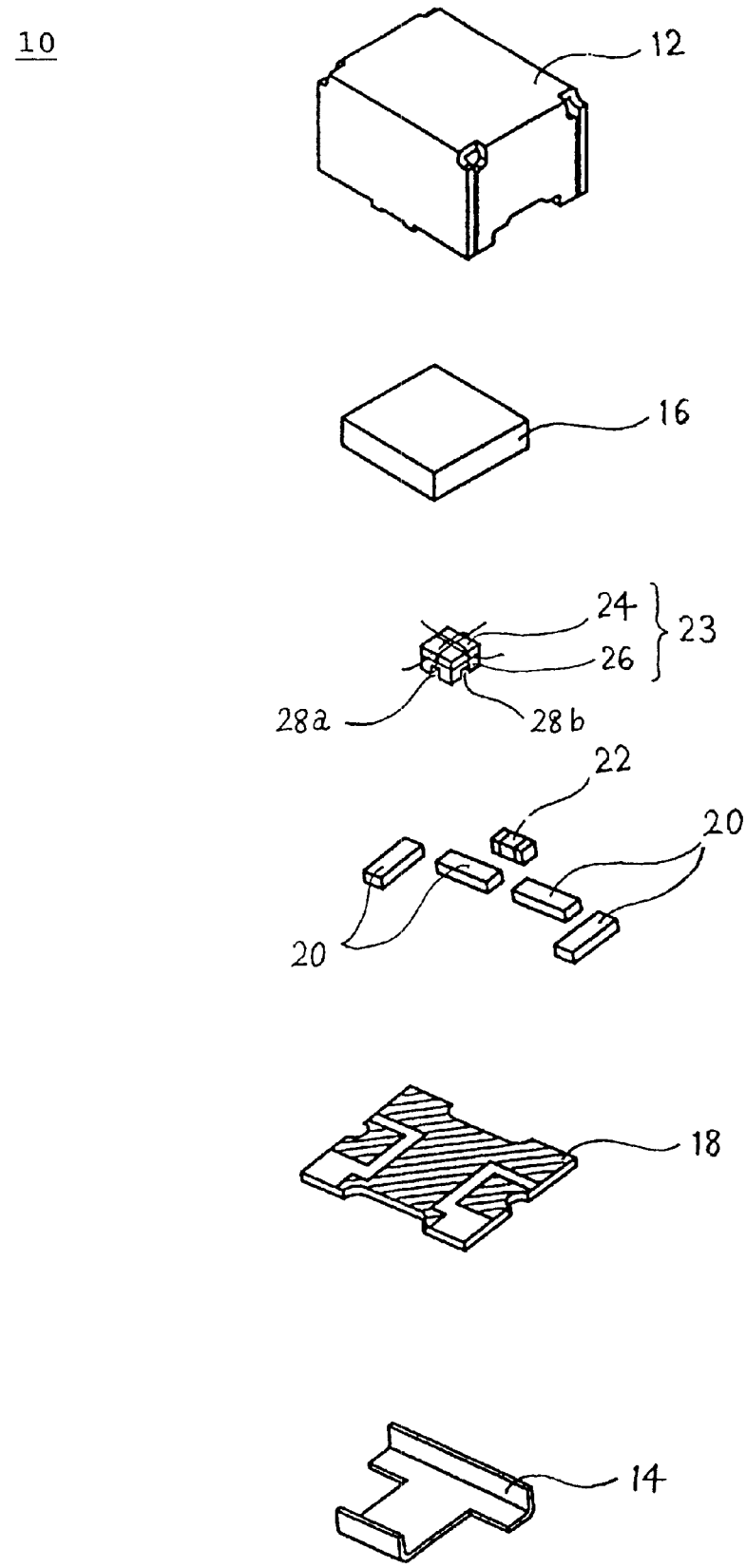
FIG. 1 is an assembly view of a two-terminal isolator according to a preferred embodiment of the present invention.

FIG. 1 is an assembly view of a two-terminal isolator including a nonreciprocal circuit device according to a preferred embodiment of the present invention.

In the present preferred embodiment, the two-terminal isolator preferably has the following exemplary dimensions, approximately 3.2 mm×2.5 mm×2.0 mm.

Referring to FIG. 1, an isolator 10 includes an upper yoke 12, a lower yoke 14, a permanent magnet 16, a resin substrate 18, four capacitors 20, a resistor 22, and a single crystal composite 23. The permanent magnet 16 and the substrate 18 are arranged between the upper yoke 12 and the lower yoke 14. The capacitors 20, the resistor 22, and the single crystal composite 23 are provided on the substrate 18.

The single crystal composite 23 is preferably defined by a nonmagnetic garnet single crystal substrate 26 and a magnetic garnet single crystal 24 grown on the garnet single crystal substrate 26 by liquid phase epitaxy (LPE method). The surface of the garnet single crystal substrate 26 opposite to the surface provided with the magnetic garnet single crystal 24 includes two grooves 28*a* and 28*b*. The grooves 28*a* and 28*b* extend substantially parallel to the main surfaces of the magnetic garnet single crystal 24 and intersect each other at the approximate center of the surface of the garnet single crystal substrate 26.

Center electrodes are provided on the surface of the single crystal composite 23 defined by two coated copper wires 30*a* and 30*b*. The configuration of the center electrodes is described below with reference to FIGS. 2A and 2B.

Figure 2A:
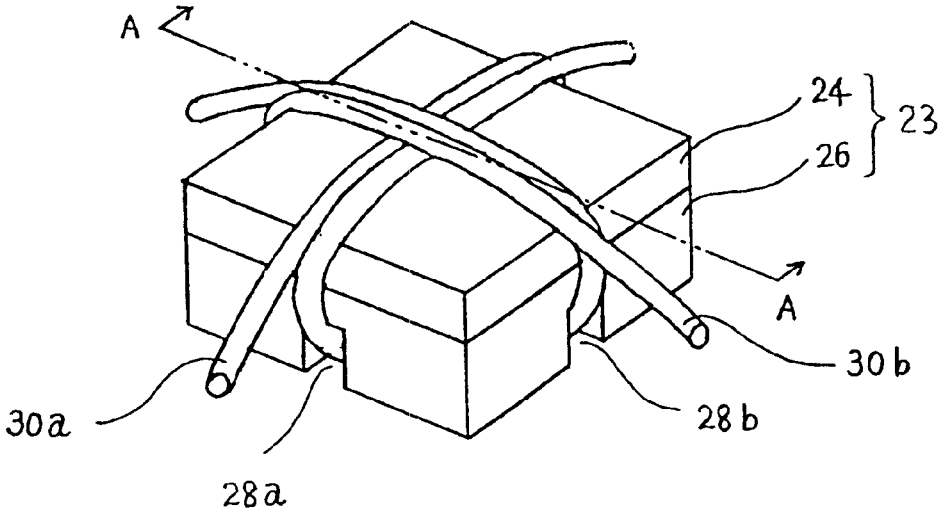
FIG. 2A is a perspective view of a single crystal composite provided with coated copper wires so as to provide center electrodes which define the two-terminal isolator shown in FIG. 1.
Figure 2B:
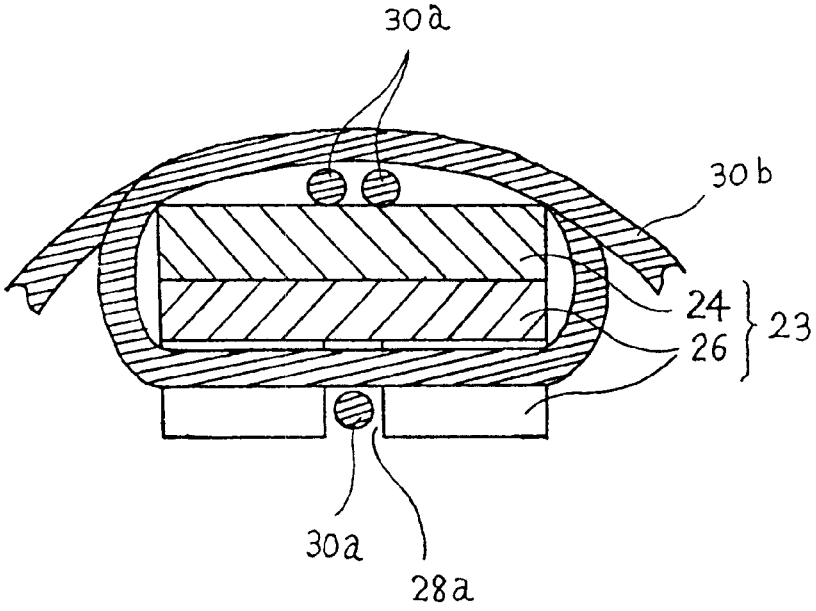
FIG. 2B is a cross-sectional view of the single crystal composite taken along line A–A' in FIG. 2A.

FIG. 2A is a perspective view of the single crystal composite 23 provided with the center electrodes defined by the coated copper wires 30*a* and 30*b*. FIG. 2B is a cross-sectional view taken along a two-dot chain line A–A' in FIG. 2A.

As shown in FIGS. 2A and 2B, center portions of the coated copper wires 30*a* and 30*b* are respectively arranged in the grooves 28*a* and 28*b* provided on the garnet single crystal substrate 26 of the single crystal composite 23. The end portions of the coated copper wires 30*a* and 30*b* are wound around the single crystal composite 23. The coated copper wires 30*a* and 30*b* overlap each other at the approximate centers of the top and bottom surfaces of the single crystal composite 23.

One end of each of the coated copper wires 30*a* and 30*b* defining the center electrodes is grounded to the substrate 18 shown in FIG. 1. The other end of the coated copper wire 30*a* is connected in series to an input terminal via one of the capacitors 20 and is also connected in parallel to another one of the capacitors 20. The other end of the coated copper wire 20*b* is connected in series to an output terminal via another one of the capacitors 20 and is also connected in parallel to another one of the capacitors 20. The resistor 22 is connected in series between the two series capacitors 20.

The present invention will now be described by way of examples of preferred embodiments thereof.

A magnetic garnet single crystal ($Y_3Fe_5O_{12}$) layer was grown on a nonmagnetic garnet single-crystal substrate ($Gd_3Ga_5O_{12}$) by the LPE method to prepare a single crystal composite.

A plurality of sample pieces was cut from the resulting single crystal composite. Each sample piece had a planar dimension of about 0.5 mm×about 0.5 mm, a thickness of the magnetic garnet single crystal layer of about 0.1 mm, and a thickness of the nonmagnetic garnet single crystal substrate of about 0.2 mm.

For each of the prepared sample pieces, the two grooves 28*a* and 28*b* were provided on the surface of the nonmagnetic garnet single crystal substrate opposite to the surface provided with the magnetic garnet single crystal layer using a dicing saw. The grooves 28*a* and 28*b* of which each width is about 0.07 mm intersect each other at the approximate center of the surface and had a depth shown in Table 1.

TABLE 1

| Sample No. | Depth of the groove (mm) | Location of the bottom of the groove/Distance between the bottom of the groove and the interface between the magnetic garnet single crystal layer and the nonmagnetic garnet single crystal substrate (mm) | Insertion loss (dB) |
|---|---|---|---|
| 1 | 0 | In the substrate/0.20 | 2.8 |
| 2 | 0.05 | In the substrate/0.15 | 1.9 |
| 3 | 0.15 | In the substrate/0.05 | 1.4 |
| 4 | 0.20 | At the interface/0 | 0.9 |
| 5 | 0.25 | In the magnetic garnet single crystal/0.05 | 1.2 |

TABLE 1-continued

| Sample No. | Depth of the groove (mm) | Location of the bottom of the groove/Distance between the bottom of the groove and the interface between the magnetic garnet single crystal layer and the nonmagnetic garnet single crystal substrate (mm) | Insertion loss (dB) |
|---|---|---|---|
| 6 | 0.27 | In the magnetic garnet single crystal/0.07 | 1.8 |

As shown in FIGS. 2A and 2B, the center portions of the two coated copper wires 30*a* and 30*b* were respectively arranged in the grooves 28*a* and 28*b* of each of the resulting single crystal composites. The end portions of the coated copper wires 30*a* and 30*b* were wound around the single crystal composite 23 so as to form the center electrodes. Subsequently, the center electrodes and other components shown in FIG. 1 were assembled to form the two-terminal isolator 10. In this example, the grooves 28*a* and 28*b* were provided in the single crystal composite after the composite was cut into a size of a nonreciprocal circuit device. Alternatively, the grooves 28*a* and 28*b* may be provided before the cutting.

Next, the relationship between the insertion loss and depth of the grooves 30*a* and 30*b* provided in the single crystal composite was determined for each prepared two-terminal isolator 10. The results are shown in Table 1. In Table 1, the expression "in the substrate" means in the nonmagnetic garnet single crystal substrate.

Referring to Table 1, the two-terminal isolator of Sample 2 including having a depth of about 0.05 mm formed in the nonmagnetic garnet single crystal substrate has an improved insertion loss as compared with Sample 1 having no grooves.

As shown in Samples 3 and 4, as the bottom of the groove get closer to the interface between the magnetic garnet single crystal and the nonmagnetic garnet single crystal substrate, the distance between the coated copper wire arranged in the groove and the magnetic garnet single crystal decreases and the insertion loss decreases.

Samples 5 and 6 which include grooves extending past the interface between the magnetic garnet single crystal and the nonmagnetic garnet single crystal substrate also have improved insertion loss as compared with Sample 1 having no grooves. However, since the effective thickness of the magnetic garnet single crystal layer decreases, the insertion loss increases after the depth of the grooves reaches the interface.

Figure 3:
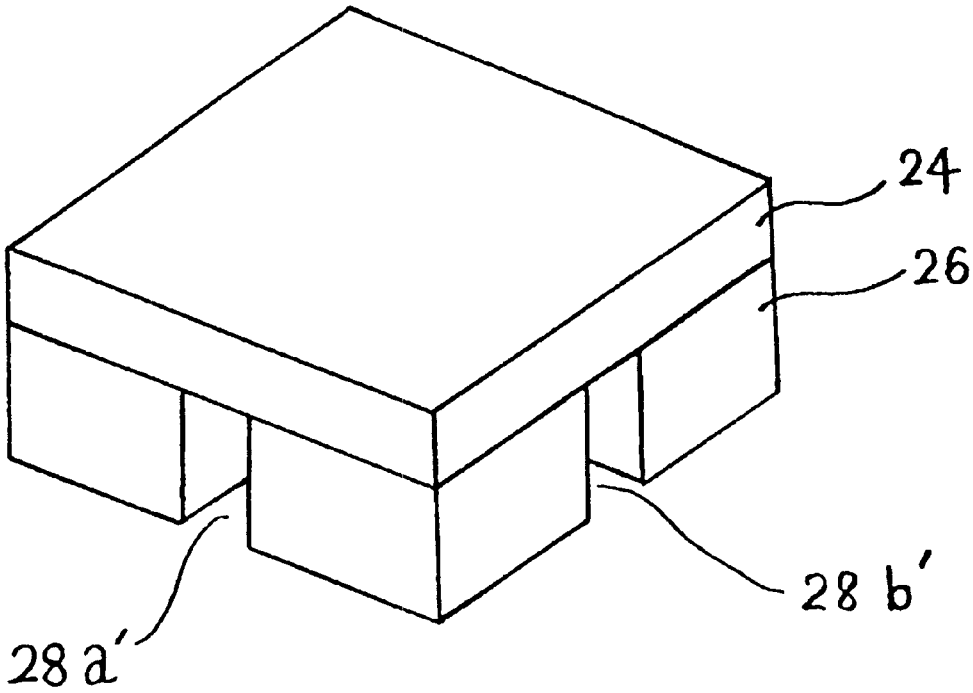
FIG. 3 is a perspective view of another single crystal composite which defines the two-terminal isolator shown in FIG. 1.

Accordingly, when the smallest insertion loss is needed, the groove is arranged so as to reach the interface between the magnetic garnet single crystal 24 and the nonmagnetic garnet single crystal substrate 26, and the magnetic garnet single crystal 24 defines the base of the grooves 28*a'* and 28*b'* which are provided on the single crystal having the substrate shown in FIG. 3, and the nonmagnetic garnet single crystal 26 defines the sides of the grooves 28*a'* and 28*b'*.

With this structure, when a center electrode is defined by coated copper wires provided on a surface of a single crystal, the nonmagnetic substrate is not interposed between the center electrode conductor and the magnetic body, and the thickness of the magnetic body is sufficiently maintained. Therefore, the insertion loss of the above-described structure is reduced to the greatest extent in sample 4 as shown in Table 1.

Although the present invention is described with reference to two-terminal isolators for use in a 1 GHz band in the above examples, the present invention can be effectively used in other frequency bands and can be applied to nonreciprocal circuit devices such as lumped element isolators and circulators other than the two-terminal isolators. The overall structure of the present invention is not limited to that shown in FIG. 1.

While preferred embodiments of the present invention have been described above, it is to be understood that variations and modifications will be apparent to those skilled in the art without departing the scope and spirit of the invention. The scope of the invention, therefore, is to be determined solely by the following claims.

What is claimed is:

1. A nonreciprocal circuit device comprising:

a center electrode including:

a nonmagnetic substrate including a first surface having a groove;

a magnetic body provided on a second surface of the nonmagnetic substrate; and a center electrode conductor, a portion of the center electrode conductor being arranged in the groove; and a magnet arranged to apply a direct-current magnetic field to the magnetic body, the magnet being disposed in proximity to the magnetic body.

2. The nonreciprocal circuit device according to claim 1, wherein the magnetic body includes a side of the groove, and the nonmagnetic substrate includes a base of the groove.

3. The nonreciprocal circuit device according to claim 1, wherein the center electrode conductor includes a wire having an insulating coating, and the center electrode conductor is wound around the nonmagnetic substrate and the magnetic body.

4. The nonreciprocal circuit device according to claim 1, wherein the center electrode conductor includes a wire having an insulating coating, and the center electrode conductor is only wound around the magnetic body.

5. The nonreciprocal circuit device according to claim 1, wherein the magnetic body includes a magnetic garnet single crystal.

6. The nonreciprocal circuit device according to claim 1, wherein the magnetic body is produced by liquid phase epitaxy.

7. The nonreciprocal circuit device according to claim 1, wherein the nonmagnetic substrate includes a nonmagnetic garnet single crystal.

8. The nonreciprocal circuit device according to claim 1, wherein the first surface of the nonmagnetic substrate further includes an additional groove.

9. The nonreciprocal circuit device according to claim 8, wherein the groove and the additional groove intersect each other at the approximate center of the nonmagnetic substrate.

10. A center electrode for use in a nonreciprocal circuit device comprising:

a nonmagnetic substrate including a first surface having a groove;

a magnetic body provided on a second surface of the nonmagnetic substrate; and a center electrode conductor, a portion of the center electrode conductor being arranged in the groove.

11. The center electrode according to claim 10, wherein the magnetic body includes a side of the groove, and the nonmagnetic substrate includes a base of the groove.

12. The center electrode according to claim 10, wherein the center electrode conductor includes a wire having an insulating coating, and the center electrode conductor is wound around the nonmagnetic substrate and the magnetic body.

13. The center electrode according to claim 10, wherein the center electrode conductor includes a wire having an insulating coating, and the center electrode conductor is only wound around the magnetic body.

14. The center electrode according to claim 10, wherein the magnetic body includes a magnetic garnet single crystal.

15. The center electrode according to claim 10, wherein the magnetic body is produced by liquid phase epitaxy.

16. The center electrode according to claim 10, wherein the nonmagnetic substrate includes a nonmagnetic garnet single crystal.

17. The center electrode according to claim 10, wherein the first surface of the nonmagnetic substrate further includes an additional groove.

18. The center electrode according to claim 17, wherein the groove and the additional groove intersect each other at the approximate center of the nonmagnetic substrate.

* * * * *